US011610551B2

(12) United States Patent
Lee et al.

(10) Patent No.: US 11,610,551 B2
(45) Date of Patent: Mar. 21, 2023

(54) DISPLAY DEVICE AND METHOD OF SENSING A THRESHOLD VOLTAGE

(71) Applicants: Samsung Display Co., Ltd., Yongin-si (KR); SEOUL NATIONAL UNIVERSITY R&DB FOUNDATION, Seoul (KR)

(72) Inventors: Sangik Lee, Seoul (KR); Kyeong Soo Kang, Seongnam-si (KR); Joon-Chul Goh, Suwon-si (KR); Soo Yeon Lee, Seoul (KR)

(73) Assignees: Samsung Display Co., Ltd., Yongin-si (KR); Seoul National University R & DB Foundation, Seoul (KR)

( * ) Notice: Subject to any disclaimer, the term of this patent is extended or adjusted under 35 U.S.C. 154(b) by 0 days.

(21) Appl. No.: 17/576,180

(22) Filed: Jan. 14, 2022

(65) Prior Publication Data

US 2022/0406259 A1 Dec. 22, 2022

(30) Foreign Application Priority Data

Jun. 21, 2021 (KR) ..... 10-2021-0080303

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2300/0842* (2013.01); *G09G 2310/061* (2013.01); *G09G 2310/08* (2013.01)

(58) Field of Classification Search
None
See application file for complete search history.

(56) References Cited

U.S. PATENT DOCUMENTS 8,816,728 B2 8/2014 Yoon et al.
9,330,605 B2 5/2016 Park
(Continued)

FOREIGN PATENT DOCUMENTS

KR 10-2017-0003247 1/2017
KR 10-2017-0006350 1/2017
(Continued)

*Primary Examiner* — Nitin Patel
*Assistant Examiner* — Amen W Bogale
(74) *Attorney, Agent, or Firm* — H.C. Park & Associates, PLC

(57) ABSTRACT

A display device includes a display panel, a scan driver, a data driver, a sensing circuit, and a controller configured to select a pixel row from a plurality of pixel rows in a vertical blank period of each frame period. The vertical blank period includes a sensing time in which the sensing circuit performs a sensing operation for the selected pixel row. The sensing circuit measures a first source voltage of a driving transistor of each pixel in the selected pixel row at a first time point of the sensing time, and measures a second source voltage of the driving transistor at a second time point of the sensing time. The controller predicts a current saturated source voltage of the driving transistor based on the first and second source voltages, and determines a threshold voltage change amount of the driving transistor based on a difference between a previous saturated source voltage and the current saturated source voltage.

20 Claims, 13 Drawing Sheets

(56) References Cited

U.S. PATENT DOCUMENTS

| | | | | |
|---|---|---|---|---|
| 9,734,800 | B2 | 8/2017 | Han et al. | |
| 9,830,854 | B2 | 11/2017 | Kim et al. | |
| 2015/0187268 | A1* | 7/2015 | Tani | G09G 3/3233 345/77 |
| 2021/0201787 | A1* | 7/2021 | Yuan | G09G 3/3291 |
| 2022/0013072 | A1* | 1/2022 | Kim | G09G 3/3266 |

FOREIGN PATENT DOCUMENTS

| | | |
|---|---|---|
| KR | 10-2075920 | 2/2020 |
| KR | 10-2122542 | 6/2020 |
| KR | 10-2156776 | 9/2020 |
| KR | 10-2021-0007508 | 1/2021 |

* cited by examiner

FIG. 8

$$I_{ds}(t)=\frac{1}{2}\mu_n C_{ox}\frac{W}{L}\cdot(V_{gs}(t)-V_{th})^2 \quad (310)$$

$$0=C_{line}\cdot V_s \quad (330)$$

$$V_{eff}(t)=V_{gs}(t)-V_{th}\ \&\ k=\frac{1}{2}\mu_n C_{ox}\frac{W}{L}$$

$$I_{ds}(t)=k\cdot V_{eff}(t)^2 \quad (320)$$

$$\frac{dQ}{dt}=C_{line}\cdot\frac{dV_s(t)}{dt}=-C_{line}\cdot\frac{dV_{eff}(t)}{dt} \quad (340)$$

$$k\cdot V_{eff}(t)^2=-C_{line}\cdot\frac{dV_{eff}(t)}{dt} \quad (350)$$

$$V_{eff}(t)=\frac{1}{\frac{1}{V_g-V_s(0)-V_{th}}+\frac{k}{C_{line}}t} \quad (360)$$

$$V_{eff}(t)=V_g-V_s(t)-V_{th}=\frac{1}{\frac{1}{V_g-V_s(0)-V_{th}}+\frac{k}{C_{line}}t} \quad (365)$$

$$V_{th}=V_g-\left(\boxed{\frac{2\gamma}{-\beta\gamma+\sqrt{\beta^2\gamma^2+4\beta\gamma}}+V_s(0)}\right) \quad (370)$$

SVs $$\left(\beta=\frac{k}{C_{line}}t,\ \gamma=V_s(t)-V_s(0)\right)$$

$$V_s(0)=0V$$

$$SV_s=\frac{2\gamma}{-\beta\gamma+\sqrt{\beta^2\gamma^2+4\beta\gamma}} \quad (380)$$

$$SV_s=\frac{\gamma}{2}+\sqrt{\frac{\gamma^2}{4}+\frac{\gamma}{\beta}} \quad (390)$$

$$\left(\beta=\frac{k}{C_{line}}t,\ \gamma=V_s(t)\right)$$

FIG. 10

410

$$Q = C_{line} \cdot V_s$$

$$\Downarrow$$

420

$$I_{ds}(t) \cdot \Delta t = C_{line} \cdot \Delta V_s$$

425

$$\Downarrow \quad I_{ds}(t) = k(V_{gs}(t)) \cdot (V_{gs}(t) - V_{th})^2$$

$$\Downarrow$$

430

$$k(V_{gs}(t)) = C_{line} \cdot \frac{\Delta V_s}{\Delta t} \cdot \frac{1}{(V_{gs}(t) - V_{th})^2}$$

$$\Downarrow$$

440

$$k(V_{gs}(t)) = C_{line} \cdot \frac{V_s(T2) - V_s(T1)}{T2 - T1} \cdot \frac{1}{(V_g - V_s(T1) - V_{th})^2}$$

$$\Downarrow$$

445

$$\beta = \frac{k(V_{gs}(t))}{C_{line}} \cdot t$$

450

$$\beta = \frac{V_s(T2) - V_s(T1)}{T2 - T1} \cdot \frac{1}{(V_g - V_s(T1) - V_{th})^2} \cdot T1$$

FIG. 11

$$SVs = \frac{Vs(t)}{2} + \sqrt{\frac{Vs(t)^2}{4} + \frac{Vs(t)}{\beta}} \quad (510)$$

$$\Downarrow$$

$$\left[SVs - \frac{Vs(t)}{2}\right]^2 = \frac{Vs(t)^2}{4} + \frac{Vs(t)}{\beta} \quad (520)$$

$$\Downarrow$$

$$SVs^2 - Vs(t) * SVs = \frac{Vs(t)}{\beta} \quad (530)$$

$$\Downarrow$$

$$SVs^2 - Vs(T1) * SVs = \frac{Vs(T1)*(T2-T1)*(SVs-Vs(T1))^2}{[Vs(T2)-Vs(T1)]*T1} \quad (540)$$

$$\Downarrow$$

$$SVs = \frac{Vs(T1)^2 * (T2-T1)}{Vs(T1)*(T2-T1)-[Vs(T2)-Vs(T1)]*T1} \quad (550)$$

DISPLAY DEVICE AND METHOD OF SENSING A THRESHOLD VOLTAGE

CROSS-REFERENCE TO RELATED APPLICATIONS

This application claims priority to and the benefit of Korean Patent Application No. 10-2021-0080303, filed Jun. 21, 2021, which is hereby incorporated by reference for all purposes as if fully set forth herein.

BACKGROUND

Field

One or more embodiments generally relate to a display device, and, more particularly, to a display device configured to perform a sensing operation, and a method of sensing a threshold voltage of a driving transistor.

Discussion

Even when a plurality of pixels included in a display device, such as an organic light emitting diode (OLED) display device, is manufactured by the same process, driving transistors of the plurality of pixels may have different driving characteristics (e.g., different threshold voltages) from each other due to a process variation, and/or the like. Thus, the plurality of pixels may emit light with different luminance. Further, as the display device operates over time, the plurality of pixels may degrade, and the driving characteristics of the driving transistors may degrade. To compensate for initial non-uniformity of luminance and for the degradation, the display device may perform a sensing operation that senses the driving characteristics of the driving transistors of the plurality of pixels. However, to accurately sense the driving characteristics of the driving transistors of the plurality of pixels, a sufficient sensing time (e.g., tens of milliseconds (ms)) is used to saturate source voltages of the driving transistors. This, however, can prevent the sensing operation from being performed in real time while the display device displays an image.

The above information disclosed in this section is only for understanding the background of the inventive concepts, and, therefore, may contain information that does not form prior art.

SUMMARY

Some embodiments provide a display device capable of performing a sensing operation of a threshold voltage of a driving transistor in real time.

Some embodiments provide a method of sensing a threshold voltage of a driving transistor in real time.

Additional aspects will be set forth in the detailed description which follows, and, in part, will be apparent from the disclosure, or may be learned by practice of the inventive concepts.

According to an embodiment, a display device includes a display panel, a scan driver, a data driver, a sensing circuit, and a controller. The display panel includes a plurality of pixel rows. The scan driver is configured to provide a scan signal and a sensing signal to each of the plurality of pixel rows. The data driver is coupled to the plurality of pixel rows through a plurality of data lines. The sensing circuit is coupled to the plurality of pixel rows through a plurality of sensing lines. The controller is configured to: control the scan driver, the data driver, and the sensing circuit; and select a pixel row from the plurality of pixel rows in a vertical blank period of each frame period. The vertical blank period includes a sensing time in which the sensing circuit is configured to perform a sensing operation for the selected pixel row. The sensing circuit is configured to: measure a first source voltage of a driving transistor of each pixel in the selected pixel row at a first time point of the sensing time; and measure a second source voltage of the driving transistor at a second time point of the sensing time. The controller is configured to: predict a current saturated source voltage of the driving transistor based on the first source voltage and the second source voltage; and determine a threshold voltage change amount of the driving transistor based on a difference between a previous saturated source voltage and the current saturated source voltage.

According to an embodiment, a method of sensing a threshold voltage in a display device including a plurality of pixel rows includes: selecting a pixel row from the plurality of pixel rows in a vertical blank period of each frame period; measuring a first source voltage of a driving transistor of each pixel in the selected pixel row at a first time point of a sensing time within the vertical blank period; measuring a second source voltage of the driving transistor at a second time point of the sensing time; predicting a current saturated source voltage of the driving transistor based on the first source voltage and the second source voltage; and determining a threshold voltage change amount of the driving transistor based on a difference between a previous saturated source voltage and the current saturated source voltage.

According to various embodiments, in a display device and a method of sensing a threshold voltage, first and second source voltages of a driving transistor of each pixel in a selected pixel row may be measured at first and second time points of a sensing time within a vertical blank period, a current saturated source voltage of the driving transistor may be predicted, a threshold voltage change amount of the driving transistor may be calculated (or determined) based on a difference between a previous saturated source voltage and the current saturated source voltage, and a threshold voltage of the driving transistor may be determined based on the threshold voltage change amount. Accordingly, since the current saturated source voltage of the driving transistor after saturation is predicted by the first and second source voltages of the driving transistor before saturation, a sensing operation that senses the threshold voltage of the driving transistor may be accurately and efficiently performed in real time.

The foregoing general description and the following detailed description are illustrative and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain principles of the inventive concepts.

FIG. 8 is a diagram for describing an example of equations used to predict a saturated source voltage in a method of sensing a threshold voltage according to an embodiment.

FIG. 10 is a diagram for describing an example of equations used to calculate a mobility parameter in a method of sensing a threshold voltage according to an embodiment.

FIG. 11 is a diagram for describing an example of equations used to predict a saturated source voltage based on a first source voltage and a second source voltage in a method of sensing a threshold voltage according to an embodiment.

DETAILED DESCRIPTION OF SOME EMBODIMENTS

Figure 1:
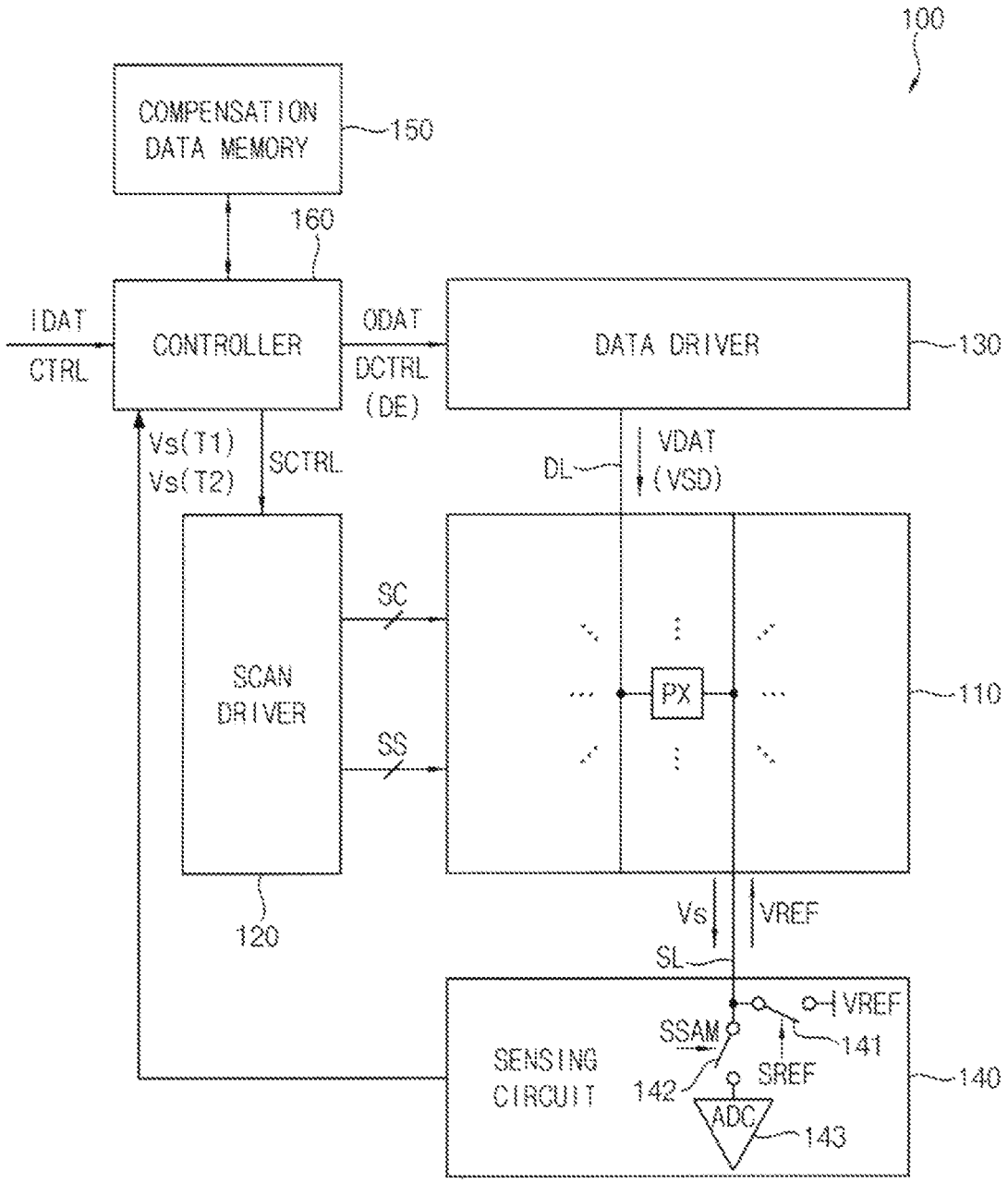
FIG. 1 is a block diagram illustrating a display device according to an embodiment.

In the following description, for the purposes of explanation, numerous specific details are set forth to provide a thorough understanding of various embodiments. As used herein, the terms "embodiments" and "implementations" may be used interchangeably and are non-limiting examples employing one or more of the inventive concepts disclosed herein. It is apparent, however, that various embodiments may be practiced without these specific details or with one or more equivalent arrangements. In other instances, well-known structures and devices are shown in block diagram form to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing example features of varying detail of some embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing some embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the inventive concepts. Further, the blocks, units, and/or modules of some embodiments may be physically combined into more complex blocks, units, and/or modules without departing from the inventive concepts.

Figure 2:
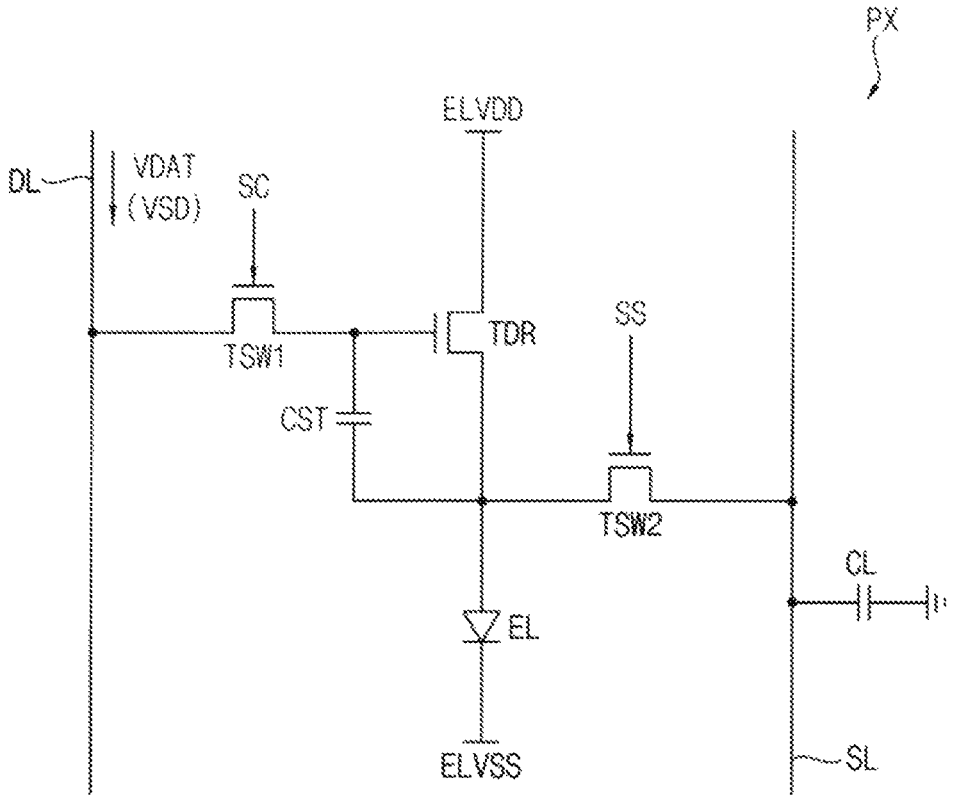
FIG. 2 is a circuit diagram illustrating an example of a pixel included in a display device according to an embodiment.
Figure 3:
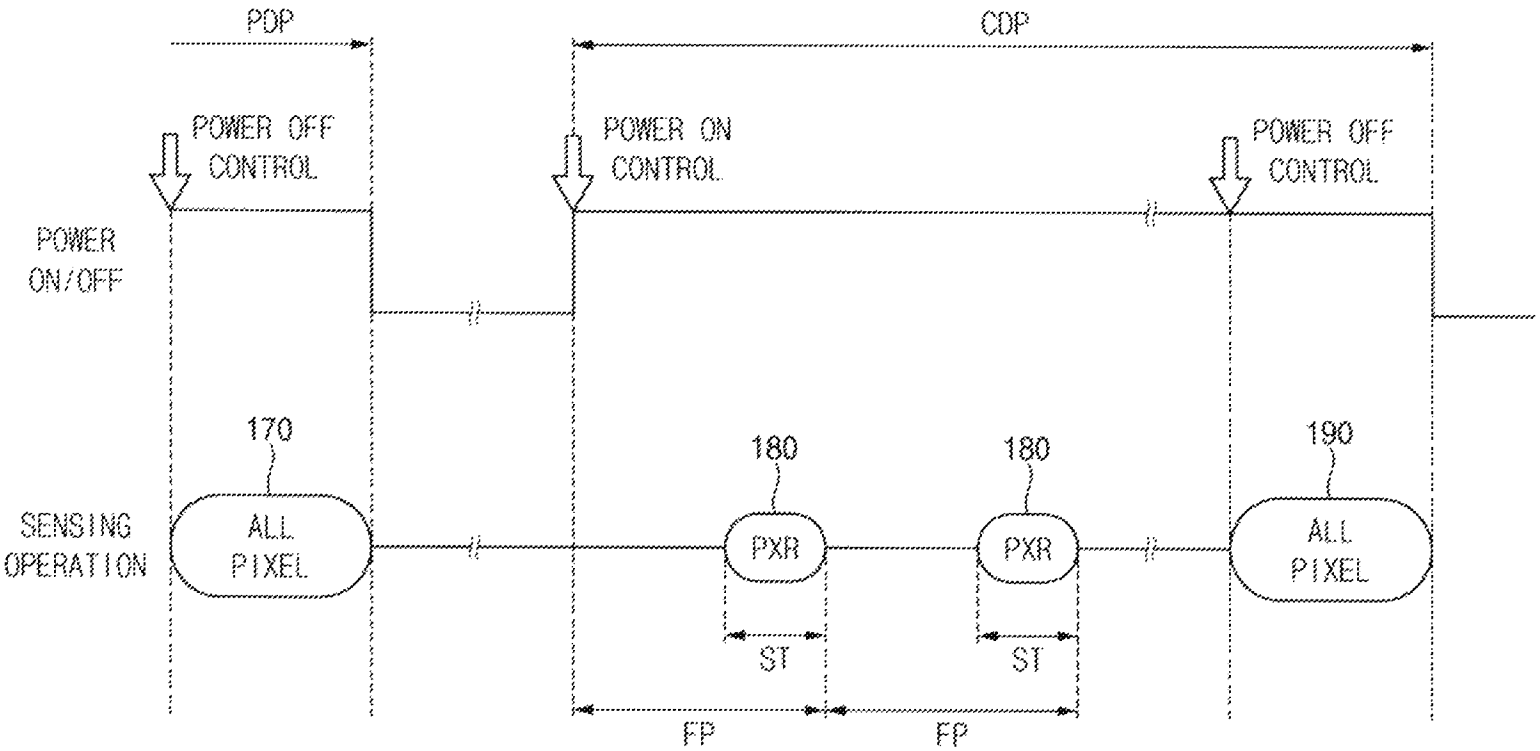
FIG. 3 is a timing diagram for describing an example of a sensing operation performed in a display device according to an embodiment.
Figure 4:
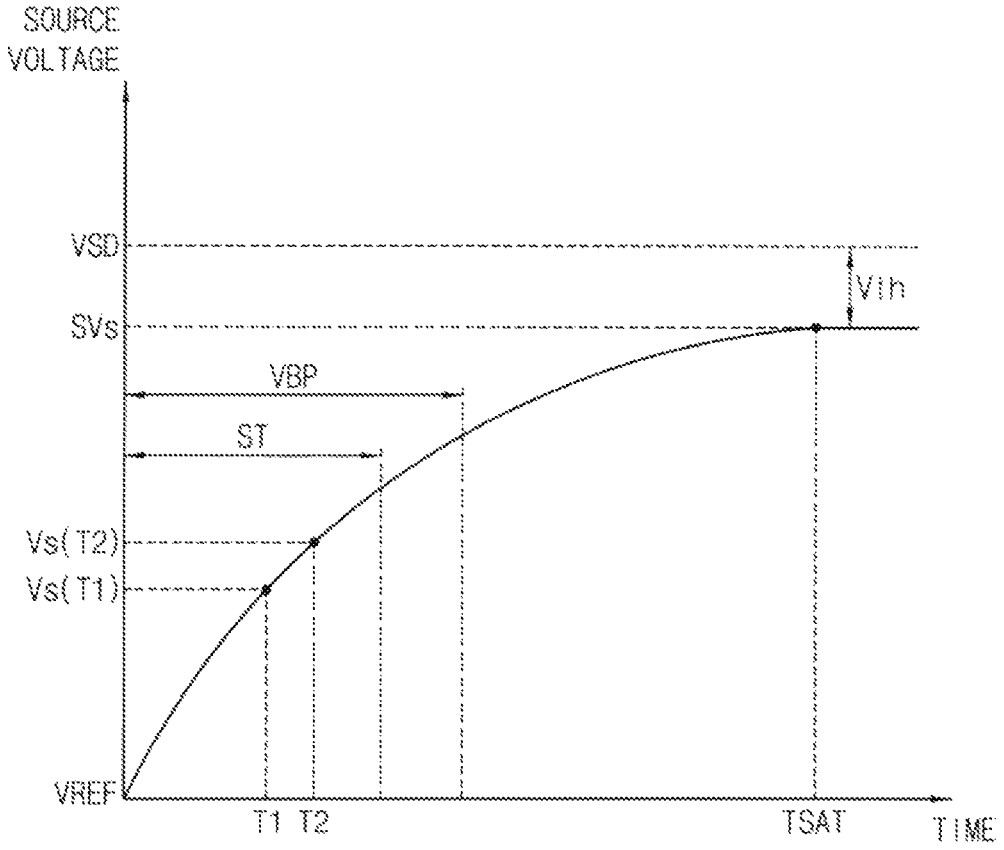
FIG. 4 is a diagram illustrating an example of a source voltage over time for describing a sensing operation of a display device according to an embodiment.

Hereinafter, various embodiments will be explained in detail with reference to the accompanying drawings FIG. 1 is a block diagram illustrating a display device according to an embodiment. FIG. 2 is a circuit diagram illustrating an example of a pixel included in a display device according to an embodiment. FIG. 3 is a timing diagram for describing an example of a sensing operation performed in a display device according to an embodiment. FIG. 4 is a diagram illustrating an example of a source voltage over time for describing a sensing operation of a display device according to an embodiment.

Referring to FIG. 1, a display device 100 according to an embodiment may include a display panel 110 that includes a plurality of pixel rows, a scan driver 120 that provides a scan signal SC and a sensing signal SS to each of the plurality of pixel rows, a data driver 130 that is coupled to the plurality of pixel rows through a plurality of data lines DL, a sensing circuit 140 that is coupled to the plurality of pixel rows through a plurality of sensing lines SL, and a controller 160 that controls the scan driver 120, the data driver 130, and the sensing circuit 140. In some embodiments, the display device 100 may further include a compensation data memory 150 that stores compensation data for compensating a threshold voltage of a driving transistor of each pixel PX.

The display panel 110 may include the plurality of data lines DL, the plurality of sensing lines SL, and the plurality of pixel rows coupled to the plurality of data lines DL and the plurality of sensing lines SL. Here, each pixel row may be a row of pixels PX, and the pixels PX in the same pixel row may receive the same scan signal SC and the same sensing signal SS. The display panel 110 may further include a plurality of scan signal lines respectively coupled to the plurality of pixel rows, and a plurality of sensing signal lines respectively coupled to the plurality of pixel rows. In some embodiments, each pixel PX may include a light emitting element, and the display panel 110 may be a light emitting display panel. For example, the display panel 110 may be, but is not be limited to, an organic light emitting diode (OLED) display panel, a quantum dot (QD) display panel, or the like.

For example, as illustrated in FIG. 2, each pixel PX may include the driving transistor TDR, a first switching transistor TSW1, a second switching transistor TSW2, a storage capacitor CST, and the light emitting element EL.

The storage capacitor CST may store a data voltage VDAT (or a sensing data voltage VSD) transferred through the data line DL and/or the sensing line SL. In some embodiments, the storage capacitor CST may include a first electrode coupled to a gate of the driving transistor TDR, and a second electrode coupled to a source of the driving transistor.

The first switching transistor TSW1 may couple the data line DL to the first electrode of the storage capacitor CST in response to the scan signal SC. Thus, the first switching transistor TSW1 may transfer the data voltage VDAT (or the sensing data voltage VSD) of the data line DL to the first electrode of the storage capacitor CST in response to the scan signal SC. In some embodiments, the first switching transistor TSW1 may include a gate receiving the scan signal SC, a drain coupled to the data line DL, and a source coupled to the first electrode of the storage capacitor CST and the gate of the driving transistor TDR.

The second switching transistor TSW2 may couple the sensing line SL to the second electrode of the storage capacitor CST and a source of the driving transistor TDR in response to the sensing signal SS. In some embodiments, the second switching transistor TSW2 may include a gate receiving the sensing signal SS, a drain coupled to the source of the driving transistor TDR, and a source coupled to the sensing line SL. The sensing line SL may be coupled to a line capacitor CL. In some embodiments, the line capacitor CL may be, but not be limited to, a parasitic capacitor of the sensing line SL.

The driving transistor TDR may generate a driving current based on the data voltage VDAT stored in the storage capacitor CST. In some embodiments, the driving transistor TDR may include the gate coupled to the first electrode of the storage capacitor CST, a drain receiving a first power supply voltage ELVDD (e.g., a high power supply voltage), and a source coupled to the second electrode of the storage capacitor CST and the drain of the second switching transistor TSW2.

The light emitting element EL may emit light in response to the driving current generated by the driving transistor TDR. According to some embodiments, the light emitting element EL may be, but is not be limited to, an OLED, a QD diode, or the like. In some embodiments, the light emitting element EL may include an anode coupled to the source of the driving transistor TDR, and a cathode receiving a second power supply voltage ELVSS (e.g., a low power supply voltage).

Although FIG. 2 illustrates an example of the pixel PX, the pixel PX of the display device 100 according to embodiments is not limited to the example of FIG. 2.

The scan driver 120 may generate the scan signals SC and the sensing signals SS based on a scan control signal SCTRL from the controller 160, and may sequentially provide the scan signals SC and the sensing signals SS to the plurality of pixels PX on a pixel row basis in an active period of each frame period. In some embodiments, the scan control signal SCTRL may include, but is not limited to, a start signal and a clock signal. In some embodiments, the scan driver 120 may be integrated or formed in a peripheral portion of the display panel 110. In other embodiments, the scan driver 120 may be implemented with one or more integrated circuits.

The data driver 130 may generate the data voltages VDAT based on output image data ODAT and a data control signal DCTRL received from the controller 160, and may provide the data voltages VDAT to the plurality of pixels PX in the active period of each frame period. In some embodiments, the data driver 130 may provide the sensing data voltage VSD to the pixels PX in a selected pixel row in a vertical blank period of each frame period. The data control signal DCTRL may include a data enable signal DE (refer to FIG. 6) that periodically transitions to inform the data driver 130 of a transfer timing of the output image data ODAT in the active period and has a low level in the vertical blank period. In some embodiments, the data control signal DCTRL may further include, but is not limited to, a horizontal start signal and a load signal. In some embodiments, the data driver 130 and the controller 160 may be implemented with at least one single integrated circuit, and the single integrated circuit may be referred to as a timing controller embedded data driver (TED) integrated circuit. In other embodiments, the data driver 130 and the controller 160 may be implemented with separate integrated circuits.

The sensing circuit 140 may provide a reference voltage VREF to the selected pixel row on which a sensing operation is performed through the plurality of sensing lines SL, and may receive source voltages Vs of the driving transistor TDR of the pixels PX in the selected pixel row through the plurality of sensing lines SL. In some embodiments, the sensing circuit 140 may include a first switch 141 that provides the reference voltage VREF to the sensing line SL in response to a reference signal SREF, a second switch 142 that couples the sensing line SL to an analog-to-digital converter (ADC) 143 in response to a sampling signal S SAM, and the ADC 143 that converts the source voltage Vs received through the sensing line SL into a digital signal. In some embodiments, the sensing circuit 140 may include one ADC 143 per one sensing line SL. In other embodiments, the sensing circuit 140 may include one ADC 143 per a plurality of sensing lines SL, for example four, eight, or sixteen sensing lines SL, and the ADC 143 may perform an analog-to-digital conversion operation on the source voltages Vs of the plurality of sensing lines SL in a time-division manner. In some embodiments, the sensing circuit 140 may be implemented with a separate integrated circuit from an integrated circuit of the data driver 130. In other embodiments, the sensing circuit 140 may be included in the data driver 130, or may be included in the controller 160.

The compensation data memory 150 may store the compensation data corresponding to the threshold voltage of the driving transistor TDR of each pixel PX. The compensation data may be used to apply the data voltage VDAT where the threshold voltage of the driving transistor TDR is compensated (e.g., added) to each pixel PX. In some embodiments, the compensation data memory 150 may be implemented with, but is not limited to, at least one memory device located outside and/or inside the controller 160.

In FIG. 3, a power on/off state POWER ON/OFF having a high level represents that the display device 100 is in a power-on state, and the power on/off state POWER ON/OFF having a low level represents that the display device 100 is in a power-off state. In some embodiments, such as illustrated in FIG. 3, when the display device 100 receives a power control signal representing a power-off ("POWER OFF CONTROL") of the display device 100, or when a previous driving period PDP of the display device 100 is ended, the sensing circuit 140 my perform a sensing operation 170 (e.g., an all pixel sensing operation ("ALL PIXEL")) that senses threshold voltages of driving transistors TDR of all pixels PX of the display panel 110 as reference threshold voltages, and the compensation data memory 150 may store the compensation data corresponding to the reference threshold voltages. The sensing operation 170 and 190 performed when each driving period PDP and CDP is ended may be performed for a time sufficient to allow a source voltage of the driving transistor TDR of each pixel PX to be saturated, and, thus, the sensing operation 170 and 190 may sense the reference threshold voltage by measuring an actual saturated source voltage of the driving transistor TDR of each pixel PX.

Further, once the display device 100 receives the power control signal representing a power-on ("POWER ON CONTROL") of the display device 100, or during a current driving period CDP of the display device 100, the sensing circuit 140 my perform a sensing operation 180 (e.g., a pixel row sensing operation ("PXR")) for at least one selected pixel row of the display panel 110 during a sensing time ST within a vertical blank period of each frame period FP, the controller 160 may calculate (or otherwise determine) an updated threshold voltage of the driving transistor TDR by cumulatively adding a threshold voltage change amount obtained by the sensing operation 180 to the reference threshold voltage of the driving transistor TDR of each pixel PX in the selected pixel row, and the compensation data memory 150 may store the compensation data corresponding to the updated threshold voltage by updating the compensation data for the pixels PX in the selected pixel row. Since the sensing operation 180 for the selected pixel row is performed while the display panel 110 displays an image, the sensing operation 180 may be referred to as a real-time sensing operation. Further, when the current driving period CDP of the display device 100 is ended, a sensing operation 190 for all pixels PX of the display panel 110 may be performed to obtain the reference threshold voltages to be used in a next driving period.

The controller 160 (e.g., a timing controller (TCON)) may receive input image data IDAT and a control signal CTRL from an external host processor (e.g., a graphic processing unit (GPU), an application processor (AP), or a graphic card). In some embodiments, the control signal CTRL may include, but is not limited to, a vertical synchronization signal, a horizontal synchronization signal, an input data enable signal, a master clock signal, etc. The controller 160 may generate the output image data ODAT by correcting the input image data IDAT based on the compensation data stored in the compensation data memory 150. For example, the controller 160 may generate the output image data ODAT corresponding to the data voltage VDAT where the threshold voltage corresponding to the compensation data is added to a voltage corresponding to the input image data IDAT by adding the compensation data to the input image data IDAT. Further, the controller 160 may generate the data control signal DCTRL and the scan control signal SCTRL based on the control signal CTRL. The controller 160 may control an operation of the scan driver 120 by providing the scan control signal SCTRL to the scan driver 120, and may control an operation of the data driver 130 by providing the output image data ODAT and the data control signal DCTRL to the data driver 130.

In the display device 100 according to some embodiments, the controller 160 may select at least one pixel row on which the sensing operation is to be performed from the plurality of pixel rows of the display panel 110 in a vertical blank period of each frame period. In some embodiments, the controller 160 may sequentially select the plurality of pixel rows in a plurality of frame periods such that the sensing operations for the plurality of pixel rows are sequentially performed in the plurality of frame periods. In other embodiments, the controller 160 may randomly select a pixel row on which the sensing operation is to be performed from the plurality of pixel rows of the display panel 110 in each frame period.

The vertical blank period of each frame period may include a sensing time in which the sensing circuit 140 performs the sensing operation (e.g., the real-time sensing operation) on the selected pixel row. Thus, the sensing circuit 140 may perform the sensing operation on the selected pixel row during the sensing time within the vertical blank period. In some embodiments, the vertical blank period may further include, after the sensing time, a previous data writing time in which a previous data voltage applied to each pixel PX of the selected pixel row in an active period before the vertical blank period is applied again to the pixel PX.

In some embodiments, to perform the sensing operation, the sensing circuit 140 may initialize line capacitors CL of the plurality of sensing lines SL by applying a reference voltage VREF to the plurality of sensing lines SL during a previous time immediately before the sensing time. For example, the reference voltage VREF may be, but is not be limited to, about 0V. Further, the scan driver 120 may apply the scan signal SC and the sensing signal SS to the selected pixel row during the sensing time, and the data driver 130 may apply the sensing data voltage VSD to the plurality of data lines DL during the sensing time. Thus, the sensing data voltage VSD may be applied to the gate of the driving transistor TDR of each pixel PX in the selected pixel row through the data line DL and a gate voltage of the driving transistor TDR may be fixed to the sensing data voltage VSD during the sensing time. Further, when the second switching transistor TSW2 is turned on in response to the sensing signal SS, the source of the driving transistor TDR may be coupled to the sensing line SL. In this case, such as illustrated in FIG. 4, the source voltage Vs of the driving transistor TDR may be gradually increased from the reference voltage VREF, and may be saturated to the saturated source voltage SVs corresponding to a voltage where the threshold voltage Vth of the driving transistor TDR is subtracted from the sensing data voltage VSD.

In a conventional display device, to sense the threshold voltage Vth of the driving transistor TDR, the source voltage Vs of the driving transistor TDR may be measured after the source voltage Vs of the driving transistor TDR is saturated to the saturated source voltage SVs. However, a saturated time point TSAT at which the source voltage Vs of the driving transistor TDR is saturated to the saturated source voltage SVs may be later than an end time point of the vertical blank period VBP of each frame period, and, thus, the sensing operation of the conventional display device may not be performed within the vertical blank period VBP. Thus, the conventional display device cannot perform the sensing operation in real time while displaying an image.

However, in the display device 100 according to some embodiments, the sensing circuit 140 may measure a first source voltage Vs(T1) of the driving transistor TDR of each pixel PX in the selected pixel row by sampling a voltage of the sensing line SL at a first time point T1 of the sensing time ST within the vertical blank period VBP, and may measure a second source voltage Vs(T2) of the driving transistor TDR by sampling the voltage of the sensing line SL at the second time point T2 of the sensing time ST within the vertical blank period VBP. The controller 160 may receive the first source voltage Vs(T1) and the second source voltage Vs(T2) from the sensing circuit 140, may predict a current saturated source voltage SVs of the driving transistor TDR based on the first source voltage Vs(T1) and the second source voltage Vs(T2), may calculate a threshold voltage change amount of the driving transistor TDR based on a difference between a previous saturated source voltage and the current saturated source voltage SVs, and may determine the threshold voltage Vth of the driving transistor TDR by cumulatively adding the threshold voltage change amount to the reference threshold voltage. In some embodiments, the controller 160 may calculate the current saturated source voltage SVs using an equation, "

$$SVs = \frac{Vs(T1)^2 * (T2 - T1)}{Vs(T1) * (T2 - T1) - [Vs(T2) - Vs(T1)] * T1}$$

", where SVs represents the current saturated source voltage, Vs(T1) represents the first source voltage, Vs(T2) represents the second source voltage, T1 represents the first time point, and T2 represents the second time point. Further, in some embodiments, the threshold voltage change amount of the driving transistor TDR may be calculated by subtracting the current saturated source voltage SVs obtained by a current sensing operation from the previous saturated source voltage obtained by a previous sensing operation. Accordingly, in the display device 100 according to some embodiments, since the sensing circuit 140 does not measure the current saturated source voltage SVs at the saturated time point TSAT, but measures the first and second source voltages Vs(T1) and Vs(T2) respectively at the first and second time points T1 and T2 before the saturated time point TSAT to predict the current saturated source voltage SVs, the sensing operation by the sensing circuit 140 may be performed within the vertical blank period VBP, and may be performed in real time while the display device 100 displays an image.

As described above, in the display device 100 according to some embodiments, the first and second source voltages Vs(T1) and Vs(T2) of the driving transistor TDR of each pixel PX in the selected pixel row may be measured respectively at the first and second time points T1 and T2 of the sensing time ST within the vertical blank period VBP, the current saturated source voltage SVs of the driving transistor TDR may be predicted based on the first and second source voltages Vs(T1) and Vs(T2), the threshold voltage change amount of the driving transistor TDR may be calculated based on the difference between the previous saturated source voltage and the current saturated source voltage SVs, and the threshold voltage Vth of the driving transistor TDR may be determined based on the threshold voltage change amount. As such, since the current saturated source voltage SVs of the driving transistor TDR after saturation is predicted by the first and second source voltages Vs(T1) and Vs(T2) of the driving transistor TDR before saturation, the sensing operation that senses the threshold voltage Vth of the driving transistor TDR may be accurately and efficiently performed in real time while the display device 100 displays an image.

Figure 5:
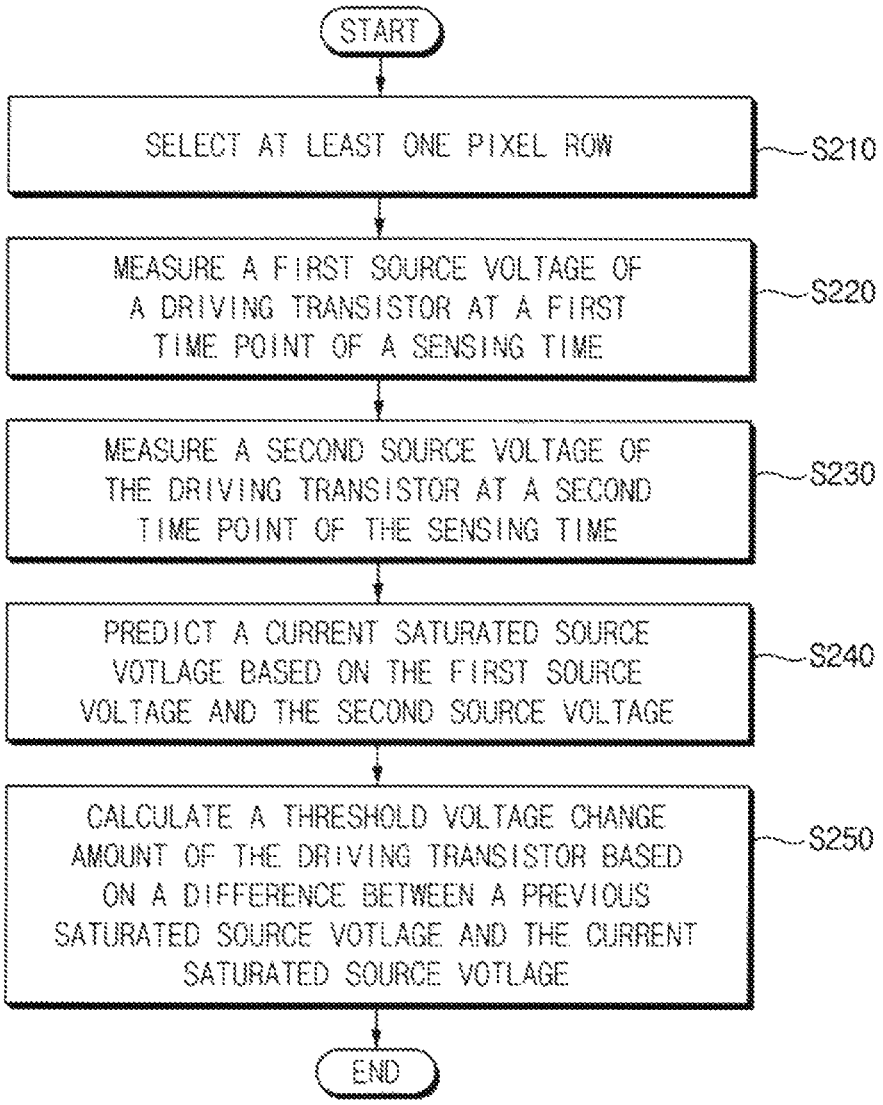
FIG. 5 is a flowchart illustrating a method of sensing a threshold voltage according to an embodiment.
Figure 6:
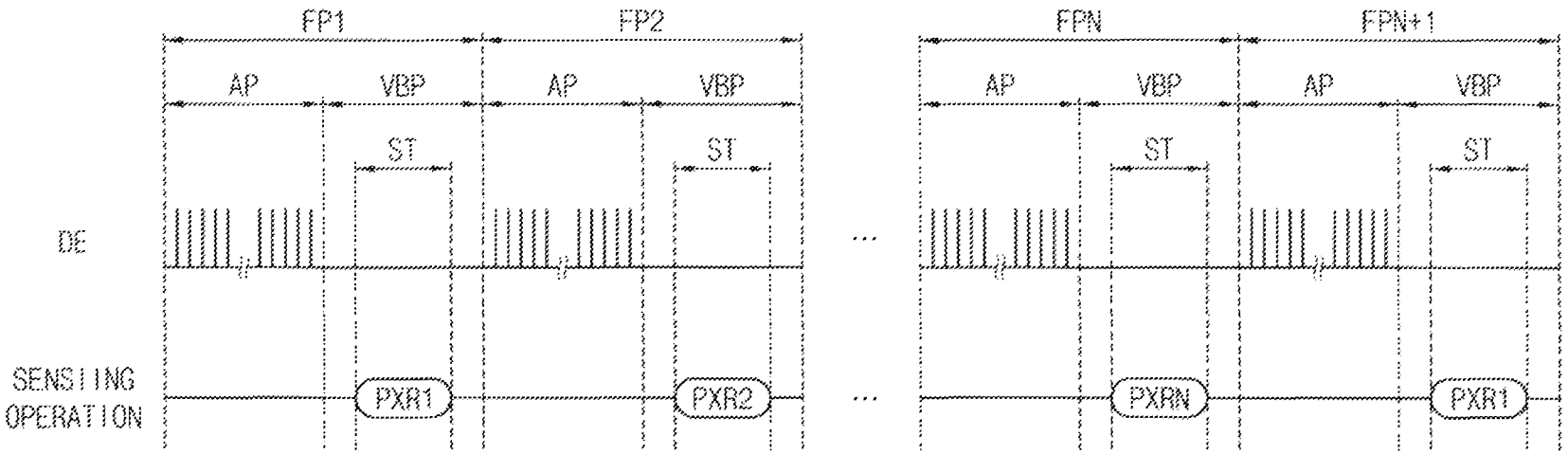
FIG. 6 is a diagram for describing an example where a pixel row on which a sensing operation is to be performed is selected in each frame period an embodiment.
Figure 7:
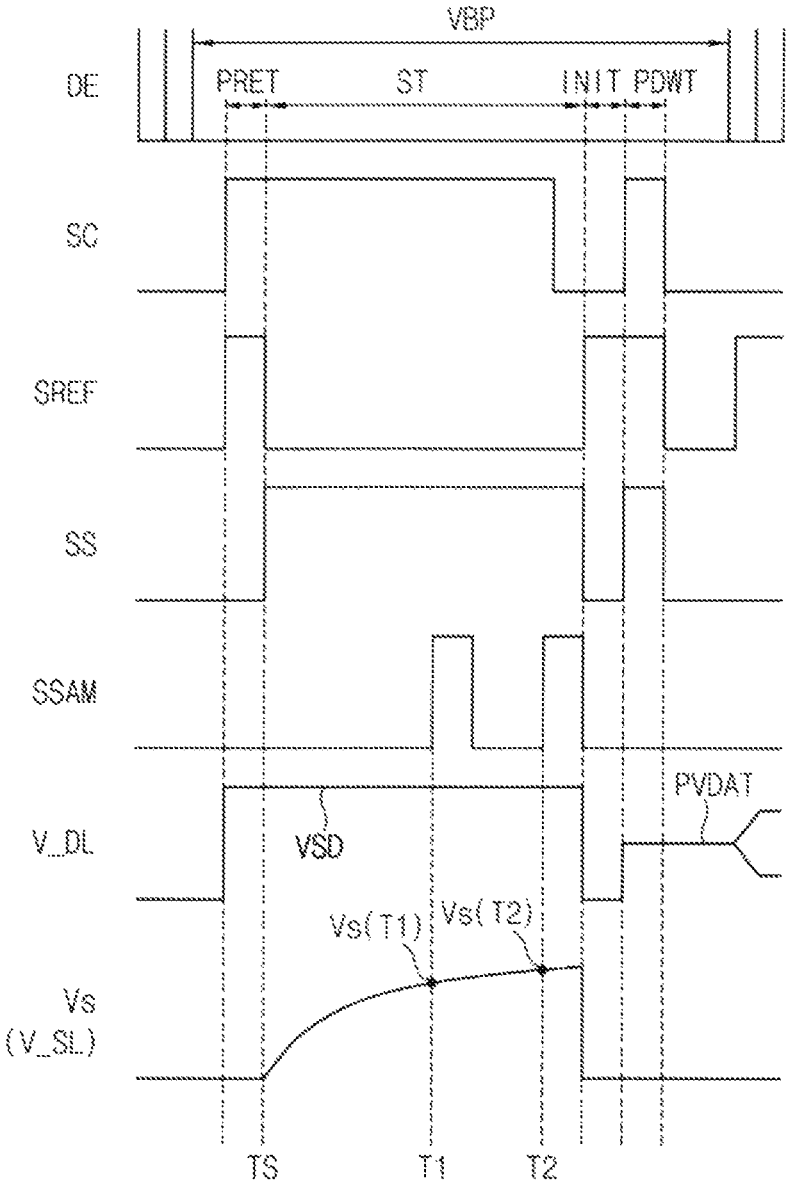
FIG. 7 is a timing diagram for describing an example of an operation of a display device in a vertical blank period according to an embodiment.
Figure 9:
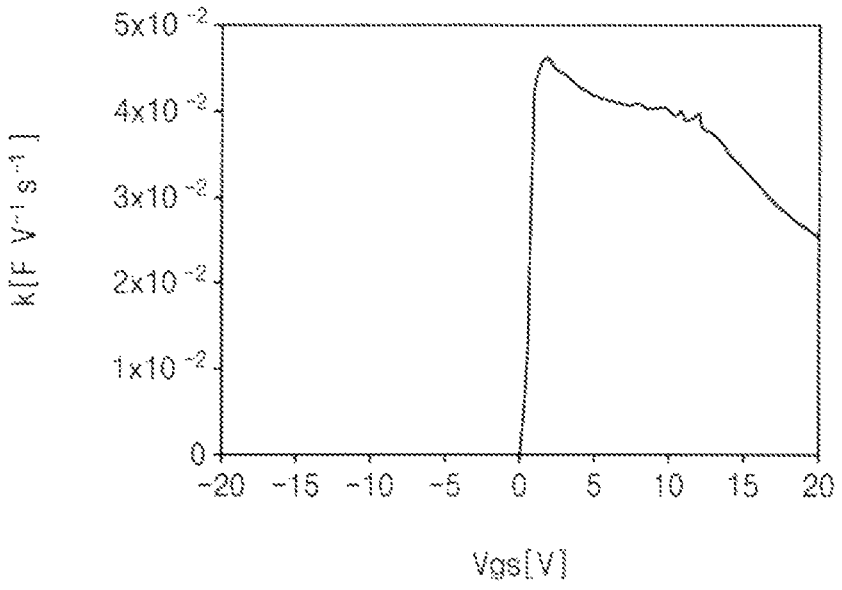
FIG. 9 is a diagram illustrating an example of a k value according to a gate-source voltage of a driving transistor an embodiment.
Figure 12:
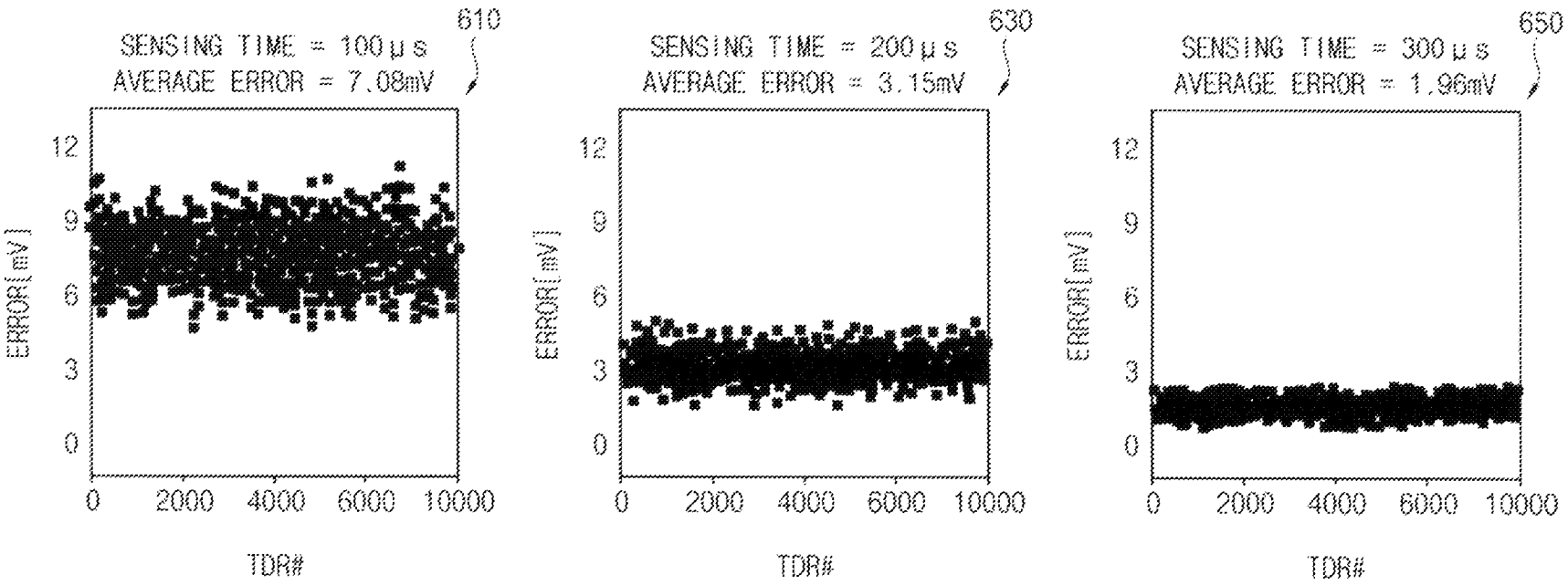
FIG. 12 is a diagram for describing examples of differences between predicted saturated source voltages and actual saturated source voltages according to sensing times in a method of sensing a threshold voltage according to an embodiment.

FIG. 5 is a flowchart illustrating a method of sensing a threshold voltage according to an embodiment. FIG. 6 is a diagram for describing an example where a pixel row on which a sensing operation is to be performed is selected in each frame period an embodiment. FIG. 7 is a timing diagram for describing an example of an operation of a display device in a vertical blank period according to an embodiment. FIG. 8 is a diagram for describing an example of equations used to predict a saturated source voltage in a method of sensing a threshold voltage according to an embodiment. FIG. 9 is a diagram illustrating an example of a k value according to a gate-source voltage of a driving transistor an embodiment. FIG. 10 is a diagram for describing an example of equations used to calculate a mobility parameter in a method of sensing a threshold voltage according to an embodiment. FIG. 11 is a diagram for describing an example of equations used to predict a saturated source voltage based on a first source voltage and a second source voltage in a method of sensing a threshold voltage according to an embodiment. FIG. 12 is a diagram for describing examples of differences between predicted saturated source voltages and actual saturated source voltages according to sensing times in a method of sensing a threshold voltage according to an embodiment.

Referring to FIGS. 1, 2 and 5, in a method of sensing a threshold voltage in a display device 100 according to some embodiments, a controller 160 may select at least one pixel row on which a sensing operation is to be performed from a plurality of pixel rows of a display panel 110 in each frame period (S210). In some embodiments, the plurality of pixel rows may be sequentially selected in a plurality of frame periods. For example, as illustrated in FIG. 6, the display panel 110 may include N pixel rows PXR1, PXR2, . . . , PXRN, where N is an integer greater than 1, and the controller 160 may sequentially select first through N-th pixel rows PXR1, PXR2, . . . , PXRN in an order from the first pixel row PXR1 to the N-th pixel row PXRN during first through N-th frame periods FP1, FP2, . . . , FPN. Each frame period FP1, FP2, . . . , FPN, and FPN+1 may include an active period AP in which the data enable signal DE periodically transitions and a vertical blank period VBP in which the data enable signal DE is fixed to a low level. A sensing circuit 140 may perform the sensing operation on the first pixel row PXR1 in a sensing time ST within the vertical blank period VBP of the first frame period FP1, may perform the sensing operation on the second pixel row PXR2 in the sensing time ST within the vertical blank period VBP of the second frame period FP2, and, in this manner, may perform the sensing operation on the N-th pixel row PXRN in the sensing time ST within the vertical blank period VBP of the N-th frame period FPN. Further, the controller 160 may select the first pixel row PXR1 again in an (N+1)-th frame period FPN+1, and the sensing circuit 140 may perform the sensing operation on the first pixel row PXR1 again in the sensing time ST within the vertical blank period VBP of the (N+1)-th frame period FPN+1. In other embodiments, the controller 160 may randomly select at least one pixel row on which the sensing operation is to be performed from the plurality of pixel rows of the display panel 110 in each frame period.

A gate voltage of a driving transistor TDR of each pixel PX in the selected pixel row may be fixed to a sensing data voltage VSD in the sensing time ST within the vertical blank period VBP. The sensing circuit 140 may measure a first source voltage Vs(T1) of the driving transistor TDR at a first time point T1 of the sensing time ST (S220), and may measure a second source voltage Vs(T2) of the driving transistor TDR at the second time point T2 of the sensing time ST (S230).

For example, as illustrated in FIG. 7, the vertical blank period VBP may include the sensing time ST in which the sensing operation is performed on the selected pixel row. In a previous time PRET before (e.g., immediately before) the sensing time ST, a scan driver 120 may provide a scan signal SC having a high level to the selected pixel row, and the data driver 130 may apply the sensing data voltage VSD to a plurality of data lines DL. The sensing data Voltage VSD may be any voltage higher than a reference voltage VREF. For example, the sensing data voltage VSD may be, but is not limited to, a 255-gray voltage, a 128-gray voltage, or the like. A first switching transistor TSW1 of each pixel PX in the selected pixel row may be turned on in response to the scan signal SC having the high level, and the first switching transistor TSW1 may transfer a voltage V_DL of the data line DL, or the sensing data voltage VSD to a gate of the driving transistor TDR and a first electrode of a storage capacitor CST. Accordingly, the driving transistor TDR may have a gate voltage corresponding to the sensing data voltage VSD. Further, the sensing circuit 140 may apply the reference voltage VREF to a plurality of sensing lines SL, and line capacitors CL of the plurality of sensing lines SL may be initialized to the reference voltage VREF. In some embodiments, the reference voltage VREF may be, but is not limited to, about 0V. For example, a first switch 141 of the sensing circuit 140 may be turned on in response to a reference signal SREF having a high level, and the reference voltage VREF may be applied to the sensing line SL through the first switch 141.

At a start time point TS of the sensing time ST, the sensing circuit 140 may stop applying the reference voltage VREF to the plurality of sensing lines SL, and the scan driver 120 may provide a sensing signal SS having a high level to the selected pixel row. For example, the first switch 141 of the sensing circuit 140 may be turned off in response to the reference signal SREF having a low level, and the reference voltage VREF may not be applied to the sensing line SL. Further, a second switching transistor TSW2 of each pixel PX in the selected pixel row may be turned on in response to the sensing signal SS having the high level, and the second switching transistor TSW2 may couple a source of the driving transistor TDR to the sensing line SL.

Since the voltage V_DL of the data line DL is the sensing data voltage VSD, and the scan signal SC has the high level, the gate voltage of the driving transistor TDR may be fixed to the sensing data voltage VSD during the sensing time ST. The driving transistor TDR may be turned on based on the sensing data voltage VSD, a drain-source current of the driving transistor TDR may flow through the second switching transistor TSW2 to the line capacitor CL of the sensing line SL, and a voltage V_SL of the sensing line SL may be gradually increased until the driving transistor TDR is turned off. Since the source of the driving transistor TDR is coupled to the sensing line SL, a source voltage Vs of the driving transistor TDR may be substantially the same as the voltage V_SL of the sensing line SL. Thus, the voltage of the sensing line SL, or the source voltage Vs of the driving transistor TDR may be gradually increased until the source voltage Vs is saturated to a saturated source voltage SVs corresponding to a voltage where a threshold voltage Vth of the driving transistor TDR is subtracted from the sensing data voltage VSD.

Before the source voltage Vs is saturated to the saturated source voltage SVs, the sensing circuit 140 may measure the first source voltage Vs(T1) of the driving transistor TDR at the first time point T1 by sampling the voltage V_SL of the sensing line SL at the first time point T1 of the sensing time ST, and may measure the second source voltage Vs(T2) of the driving transistor TDR at the second time point T2 by sampling the voltage V_SL of the sensing line SL at the second time point T2 of the sensing time ST. In some embodiments, a time from the start time point TS of the sensing time ST to the first time point T1 may be, but is not limited to, about 200 μs, and a time from the first time point T1 to the second time point T2 may be, but not be limited to, about 10 μs. For example, a second switch 142 of the sensing circuit 140 may be turned on in response to a sampling signal SSAM having a high level at the first time point T1, an ADC 143 of the sensing circuit 140 may convert the voltage V_SL of the sensing line SL at the first time point T1 into a digital signal, and the controller 160 may receive the first source voltage Vs(T1) in the form of the digital signal from the sensing circuit 140. Further, the second switch 142 of the sensing circuit 140 may be turned on in response to the sampling signal SSAM having the high level at the second time point T2, the ADC 143 of the sensing circuit 140 may convert the voltage V_SL of the sensing line SL at the second time point T2 into a digital signal, and the controller 160 may receive the second source voltage Vs(T2) in the form of the digital signal from the sensing circuit 140.

As described above, the data driver 130 may apply the sensing data voltage VSD to the plurality of data lines DL during the sensing time ST, and the scan driver 120 may apply the scan signal SC to the selected pixel row during the sensing time ST. Accordingly, the gate voltage of the driving transistor TDR may be fixed to the sensing data voltage VSD during the sensing time ST. Further, the sensing circuit 140 may apply the reference voltage VREF to the plurality of sensing lines SL in the previous time PRET, and the scan driver 120 may apply the sensing signal SS to the selected pixel row in the previous time PRET and the sensing time ST. Accordingly, the voltage V_SL of the sensing line SL, or the source voltage Vs of the driving transistor TDR may be gradually increased from the reference voltage VREF until the source voltage Vs is saturated to the saturated source voltage SVs corresponding to the voltage where the threshold voltage Vth of the driving transistor TDR is subtracted from the sensing data voltage VSD. The sensing circuit 140 may measure the first and second source voltages Vs(T1) and Vs(T2) of the driving transistor TDR at the first and second time points T1 and T2 before the source voltage Vs is saturated to the saturated source voltage SVs.

In some embodiments, the vertical blank period VBP may further include an initialization time INIT in which the sensing line SL and/or the data line DL are initialized. In the initialization time INIT, the reference voltage VREF may be applied to the sensing line SL. For example, the first switch 141 of the sensing circuit 140 may be turned on in response to the reference signal SREF having the high level, and the reference voltage VREF may be applied to the sensing line SL through the first switch 141. Further, in the initialization time INIT, the reference voltage VREF or another initialization voltage may be applied to the data line DL.

In some embodiments, the vertical blank period VBP may further include, after the sensing time ST or after the initialization time INIT, a previous data writing time PDWT in which a previous data voltage PVDAT applied to the pixel PX in the active period AP before the vertical blank period VBP is applied again to the pixel PX. In the previous data writing time PDWT, the scan driver 120 may apply the scan signal SC having the high level and the sensing signal SS having the high level to the selected pixel row on which the sensing operation is performed, the sensing circuit 140 may apply the reference voltage VREF to the plurality of sensing lines SL, and the data driver 130 may apply the previous data voltages PVDAT for the selected pixel row to the plurality of data lines DL. Accordingly, the previous data voltage PVDAT may be stored in each pixel PX of the selected pixel row in the previous data writing time PDWT, and the pixel PX may emit light based on the previous data voltage PVDAT in the next active period AP until the next data voltage VDAT is provided in the next active period AP.

The controller 160 may receive the first source voltage Vs(T1) and the second source voltage Vs(T2) from the sensing circuit 140, and may predict a current saturated source voltage SVs of the driving transistor TDR based on the first source voltage Vs(T1) and the second source voltage Vs(T2) (S240).

In some embodiments, as illustrated in FIG. 8, the current saturated source voltage SVs may be predicted using an equation 390, or "

$$SVs = \frac{\gamma}{2} + \sqrt{\frac{\gamma^2}{4} + \frac{\gamma}{\beta}}$$

". Here, SVs may represent the current saturated source voltage, γ may represent a threshold voltage parameter of the driving transistor TDR, which may be calculated by subtracting the reference voltage VREF (or Vs(0)) from the first source voltage Vs(T1). In some embodiments, the reference voltage VREF (or Vs(0)) may be about 0V, and γ may be equal to the first source voltage Vs(T1). Further, β may represent a mobility parameter of the driving transistor TDR, which may be determined by an equation, "

$$\frac{k}{c_{line}} t$$

", where k may represent a transconductance parameter of the driving transistor TDR, Cline may represent a capacitance of the line capacitor CL, and t may represent a time.

For example, as illustrated in FIG. 8, a drain-source current of the driving transistor TDR may be determined by an equation 310, or "

$$I_{ds}(t) = \frac{1}{2}\mu_n C_{ox}\frac{W}{L}\cdot(V_{gs}(t) - V_{th})^2$$

".

Here, Ids(t) may represent the drain-source current of the driving transistor TDR, $\mu_s$ may represent mobility of the driving transistor TDR, $C_{ox}$ may represent a capacitance per unit area of the driving transistor TDR, W may represent a channel width of the driving transistor TDR, L may represent a channel length of the driving transistor TDR, Vgs(t) may represent a gate-source voltage of the driving transistor TDR, and Vth may represent the threshold voltage of the driving transistor TDR. If "Vgs(t)–Vth" is replaced with an effective voltage, or "Veff(t)", and "

$$\frac{1}{2}\mu_n C_{ox}\frac{W}{L}$$

" is replaced with "k", the equation 310 may be simplified to an equation 320, or "$I_{ds}(t)=k\cdot V_{eff}(t)^2$". Here, Veff(t) may represent the effective voltage, and k may represent the transconductance parameter of the driving transistor TDR.

An amount Q of charges stored in the line capacitor CL of the sensing line SL may be determined by an equation 330, or "$Q=C_{line}\cdot V_s$". Here, Q may represent the amount of charge stored in the line capacitor CL, Cline may represent a capacitance of the line capacitor CL, and Vs may represent the source voltage of the driving transistor TDR. Since the gate voltage of the driving transistor TDR is fixed, "Veff(t)" may be "Vgs(t)–Vth=Vg–Vs(t)–Vth". Accordingly, if both sides of the equation 330 are differentiated with respect to time t, the equation 330 may become an equation 340, or "

$$\frac{dQ}{dt} = C_{line}\cdot\frac{dV_s(t)}{dt} = -C_{line}\cdot\frac{dV_{eff}(t)}{dt}$$

".

Since the drain-source current of the driving transistor TDR is applied to the line capacitor CL, the equation 320 may be substantially equal to the equation 340, and thus, an equation 350, or "

$$k\cdot V_{eff}(t)^2 = -C_{line}\cdot\frac{dV_{eff}(t)}{dt}$$

" may be extracted. If a differential equation for "Veff(t)" is solved based on the equation 350, an equation 360, or $$V_{eff}(t) = \frac{1}{\frac{1}{V_g - V_s(0) - V_{th}} + \frac{k}{C_{line}}t}$$

" may be extracted. Here, Vg may represent the gate voltage of the driving transistor TDR, or the sensing data voltage VSD, and Vs(0) may be the source voltage of the driving transistor TDR before being increased, or the source voltage of the driving transistor TDR at the start time point TS of the sensing time ST. Since "Veff(t)" is "Vgs(t)–Vth=Vg–Vs(t)–Vth", an equation 365, or "

$$V_{eff}(t) = V_g - V_s(t) - V_{th} = \frac{1}{\frac{1}{V_g - V_s(0) - V_{th}} + \frac{k}{C_{line}}t}$$

" may be extracted from the equation 360. If the equation 365 is modified with respect to "Vth", "

$$\frac{k}{C_{line}}t$$

" is replaced with the mobility parameter β, and "Vs(t)–Vs(0)" is replaced with the threshold voltage parameter γ, an equation 370, or "

$$V_{th} = V_g - \left(\frac{2\gamma}{-\beta\gamma + \sqrt{\beta^2\gamma^2 + 4\beta\gamma}} + V_s(0)\right)$$

" may be extracted. Here, "

$$\frac{2\gamma}{-\beta\gamma + \sqrt{B^2\gamma^2 + 4\beta\gamma}} + V_s(0)$$

" may be the current saturated source voltage SVs of the driving transistor TDR. The source voltage of the driving transistor TDR before being increased, or the source voltage of the driving transistor TDR at the start time point TS of the sensing time ST may be the reference voltage VREF. Thus, in a case where the reference voltage VREF is about 0V, the current saturated source voltage SVs may be "

$$\frac{2\gamma}{-\beta\gamma + \sqrt{\beta^2\gamma^2 + 4\beta\gamma}}$$

" as illustrated in an equation 380. If the equation 380 is modified, the current saturated source voltage SVs may be "

$$\frac{Y}{2} + \sqrt{\frac{Y^2}{4} + \frac{Y}{\beta}}$$

" as illustrated in an equation 390. Here, γ may represent the threshold voltage parameter, or Vs(t), and β may represent the mobility parameter, or "

$$\frac{k}{C_{line}}t$$

".

As illustrated in FIG. 9, "k" (i.e., "

$$\frac{1}{2}\mu_n C_{ox}\frac{W}{L}$$

") may not be a constant, but a variable that is changed according to the gate-source voltage Vgs of the driving transistor TDR. Thus, "k" (e.g., the transconductance parameter of the driving transistor TDR) may be expressed as "k(Vgs(t))". The mobility parameter β may be determined by "k(Vgs(t))", and may be calculated as illustrated in FIG. 10.

As illustrated in FIG. 10, if an equation 410 of FIG. 10 (or the equation 330 of FIG. 8) is differentiated and approximated with respect to time t, an equation 420, or "$I_{ds}(t)$ $\cdot\Delta t = C_{line} \cdot \Delta V_s$" may be extracted. If an equation 425 (or the equation 320 of FIG. 8), or "$I_{ds}(t) = k(V_{gs}(t)) \cdot (V_{gs}(t) - V_{th})^2$" is put into the equation 420, an equation 430, or"

$$k(V_{gs}(t)) = C_{line} \cdot \frac{\Delta V_s}{\Delta t} \cdot \frac{1}{(V_{gs}(t) - V_{th})^2}$$

" may be extracted. Here, $\Delta V_s$ may represent a source voltage difference of the driving transistor TDR, and $\Delta t$ may represent a time difference. If a difference between the first source voltage Vs(T1) and the second source voltage Vs(T2) is put into $\Delta V_s$, and a difference between the first time point T1 and the second time point T2 is put into $\Delta t$, since the gate voltage Vg of the driving transistor TDR is fixed, and the second time point T2 is substantially immediately after the first time point T1 (e.g., after about 10 μs from the first time point T1), an equation 440, or "

$$k(V_{gs}(t)) = C_{line} \cdot \frac{V_s(T2) - V_s(T1)}{T2 - T1} \cdot \frac{1}{(V_g - V_s(T1) - V_{th})^2}$$

" may be extracted from the equation 430. Further, since the mobility parameter β is determined by an equation 445, or "

$$\beta = \frac{k(V_{gs}(t))}{C_{line}} \cdot t$$

", if the equation 440 is put into the equation 445, an equation 450, or "

$$\beta = \frac{Vs(T2) - Vs(T1)}{T2 - T1} \cdot \frac{1}{(Vg \cdot Vs(T1) - Vth)^2} \cdot T1$$

" may be extracted. Here, β may represent the mobility parameter, T1 may represent the first time point, T2 may represent the second time point, Vs(T1) may represent the first source voltage, Vs(T2) may represent the second source voltage, Vg may represent the gate voltage of the driving transistor TDR, or the sensing data voltage VSD, and Vth may represent the threshold voltage of the driving transistor TDR obtained by an immediately previous sensing operation, or a previous threshold voltage.

Since the mobility parameter β calculated by the equation 450, or "

$$\beta = \frac{Vs(T2) \cdot Vs(T1)}{T2 - T1} \cdot \frac{1}{(Vg \cdot Fs(T1) \cdot Vth)^2} \cdot T1$$

" is determined by considering the previous threshold voltage, the current saturated source voltage SVs calculated by putting the mobility parameter β calculated by the equation 450 into the equation 390, or "

$$SVs = \frac{\gamma}{2} + \sqrt{\frac{\gamma^2}{4} + \frac{\gamma}{\beta}}$$

" also may be predicted by considering the previous threshold voltage. In this case, a previous prediction result may be used in a current prediction, and a current prediction result may be used in a next prediction. Thus, a prediction error may be accumulated in this chained prediction process.

However, in the method of sensing the threshold voltage according to some embodiments, the current saturated source voltage SVs may be predicted by using an equation 550 of FIG. 11, or "

$$SVs = \frac{Vs(T1)^2 * (T2 - T1)}{Vs(T1) * (T2 - T1) - [Vs(T2) - Vs(T1)] * T1}$$

" without considering the previous threshold voltage. For example, as illustrated in FIG. 11, if "Vs(t)" is put into the threshold voltage parameter γ in the equation 390 of FIG. 8, or "

$$SVs = \frac{\gamma}{2} + \sqrt{\frac{\gamma^2}{4} + \frac{\gamma}{\beta}}$$

", an equation 510, or "

$$SVs = \frac{Vs(t)}{2} + \sqrt{\frac{Vs(t)^2}{4} + \frac{Vs(t)}{\beta}}$$

" may be extracted. Further, if "

$$\frac{Vs(t)}{2}$$

" is subtracted from both sides of the equation 510, and both sides are squared, an equation 520, or "

$$\left[SVs - \frac{Vs(t)}{2}\right]^2 = \frac{Vs(t)^2}{4} + \frac{Vs(t)}{\beta},$$

" may be extracted. Further, "

$$\frac{Vs(t)^2}{4}$$

" is subtracted from both sides of the equation 520, an equation 530, or "

$$SVs^2 - Vs(t) * SVs = \frac{Vs(t)}{\beta}$$

" may be extracted. Further, if the equation 450, or "

$$\beta = \frac{Vs(T2) \cdot Vs(T1)}{T2 - T1} \cdot \frac{1}{(Vg - Vs(T1) \cdot Vth)^2} \cdot T1$$

" is put into the mobility parameter β in the equation 530, "Vg–Vth" is replaced with "SVs", and "T1" is put into "t", an equation 540, or "

$$SVs^2 - Vs(T1)*SVs = \frac{Vs(T1)*(T2-T1)*(SVs-Vs(T1))^2}{(Vs(T2)-Vs(T1))*T1}$$

" may be extracted. Further, if both sides of the equation 540 are divided by "(SVs–Vs(T1))", and are modified with respect to "SVs", the equation 550, or "

$$SVs = \frac{Vs(T1)^2*(T2-T1)}{Vs(T1)*(T2-T1)-[Vs(T2)-Vs(T1)]*T1}$$

" may be extracted. Here, SVs may represent the current saturated source voltage, Vs(T1) may represent the first source voltage, Vs(T2) may represent the second source voltage, T1 may represent the first time point, and T2 may represent the second time point. Since the equation 550 does not have a term of the previous threshold voltage, the current saturated source voltage SVs predicted using the equation 550 may not have the accumulated error.

The controller 160 may calculate a threshold voltage change amount of the driving transistor TDR based on a difference between a previous saturated source voltage obtained by a previous sensing operation and the current saturated source voltage SVs obtained by a current sensing operation (S250). In some embodiments, the controller 160 may calculate the threshold voltage change amount of the driving transistor TDR by subtracting the current saturated source voltage SVs obtained by the current sensing operation from the previous saturated source voltage obtained by the previous sensing operation.

Since the current saturated source voltage SVs is calculated based on an ideal current equation of the driving transistor TDR, or the equation 310 of FIG. 8, the current saturated source voltage SVs predicted using the equation 550 may not be completely identical to an actual saturated source voltage. However, even if the predicted current saturated source voltage SVs has an error with respect to the actual saturated source voltage, the current saturated source voltage SVs predicted using the equation 550 in the current sensing operation may be subtracted from the previous saturated source voltage predicted using the equation 550 in the previous sensing operation, and thus, the error of the previous saturated source voltage and the error of the current saturated source voltage SVs may be offset or cancelled out. Accordingly, the threshold voltage change amount calculated by subtracting the current saturated source voltage SVs from the previous saturated source voltage may be substantially the same as a difference between an actual threshold voltage in the previous sensing operation and an actual threshold voltage in the current sensing operation, or an actual threshold voltage change amount between the previous sensing operation and the current sensing operation.

The controller 160 may determine a threshold voltage of the driving transistor TDR based on the threshold voltage change amount. In some embodiments, a reference threshold voltage of each pixel PX may be sensed when a previous driving period of the display device 100 is ended, and the threshold voltage of the driving transistor TDR may be calculated by cumulatively adding the threshold voltage change amount to the reference threshold voltage during a current driving period of the display device 100. The threshold voltage determined as described above may be substantially the same as an actual threshold voltage of the driving transistor TDR. Further, a compensation data memory 150 may store compensation data corresponding to the threshold voltage of the driving transistor TDR, and the controller 160 may correct input image data IDAT based on the compensation data. Accordingly, a data voltage VDAT where the threshold voltage of the driving transistor TDR is compensated may be applied to each pixel PX, and each pixel PX may emit light with desired luminance regardless of the threshold voltage of the driving transistor TDR.

FIG. 12 illustrates a graph 610 that shows differences between the threshold voltages calculated by the method according to embodiments and the actual threshold voltages of the driving transistors TDR in a first case where the sensing time ST is about 100 μs, a graph 630 that shows differences between the threshold voltages calculated by the method according to embodiments and the actual threshold voltages of the driving transistors TDR in a second case where the sensing time ST is about 200 μs, and a graph 650 that shows differences between the threshold voltages calculated by the method according to embodiments and the actual threshold voltages of the driving transistors TDR in a third case where the sensing time ST is about 300 μs. As illustrated in FIG. 12, an average difference (or an average error) between the calculated threshold voltages and the actual threshold voltages in the first case where the sensing time ST is about 100 μs may be about 7.08 mV, the average error in the second case where the sensing time ST is about 200 μs may be about 3.15 mV, and the average error in the third case where the sensing time ST is about 300 μs may be about 1.96 mV. Thus, the threshold voltage calculated by the method according to embodiments may have a small error with respect to the actual threshold voltage, and the error may decrease as a length of the sensing time ST within the vertical blank period VBP increases.

As described above, in the method of sensing the threshold voltage according to embodiments, the first and second source voltages Vs(T1) and Vs(T2) of the driving transistor TDR of each pixel PX in the selected pixel row may be measured respectively at the first and second time points T1 and T2 of the sensing time ST within the vertical blank period VBP, the current saturated source voltage SVs of the driving transistor TDR may be predicted based on the first and second source voltages Vs(T1) and Vs(T2), the threshold voltage change amount of the driving transistor TDR may be calculated based on the difference between the previous saturated source voltage and the current saturated source voltage SVs, and the threshold voltage Vth of the driving transistor TDR may be determined based on the threshold voltage change amount. Accordingly, since the current saturated source voltage SVs of the driving transistor TDR after saturation is predicted by the first and second source voltages Vs(T1) and Vs(T2) of the driving transistor TDR before saturation, the sensing operation that senses the threshold voltage Vth of the driving transistor TDR may be accurately and efficiently performed in real time while the display device 100 displays an image.

Figure 13:
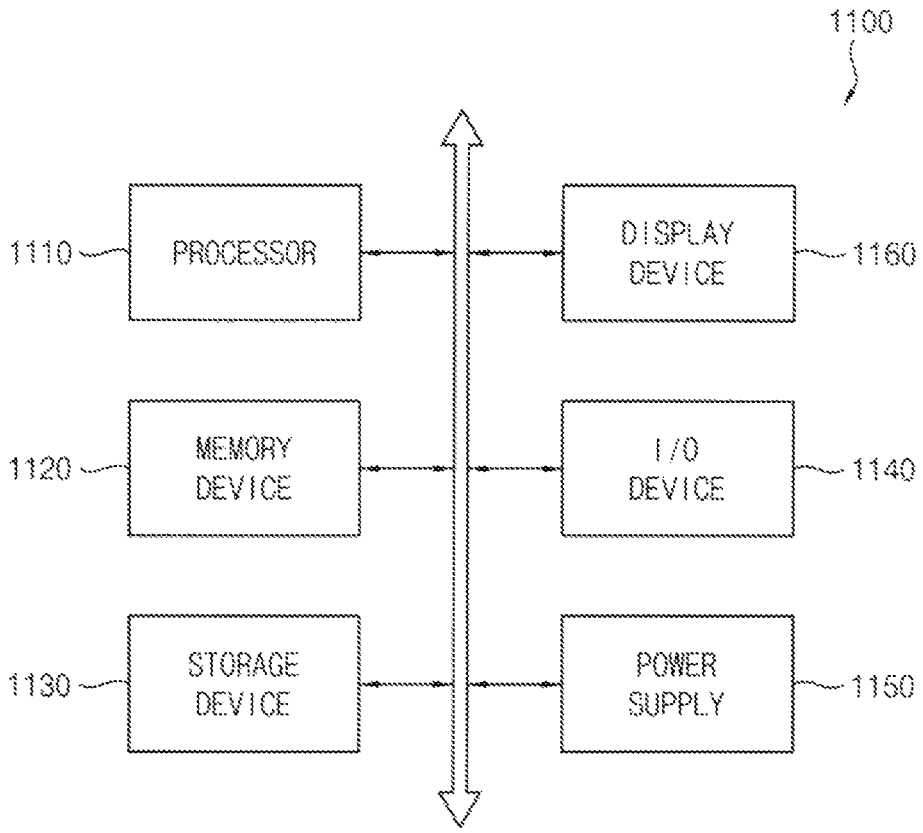
FIG. 13 is a block diagram illustrating an electronic device including a display device according to an embodiment.

FIG. 13 is a block diagram illustrating an electronic device including a display device according to an embodiment.

Referring to FIG. 13, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electronic devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some embodiments, the processor 1110 may be further coupled to an extended bus, such as a peripheral component interconnection (PCI) bus.

The memory device 1120 may store data for operations of the electronic device 1100. For example, the memory device 1120 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile dynamic random access memory (mobile DRAM) device, etc.

The storage device 1130 may be a solid-state drive (SSD) device, a hard disk drive (HDD) device, a CD-ROM device, etc. The I/O device 1140 may be an input device, such as a keyboard, a keypad, a mouse, a touch screen, etc., and an output device, such as a printer, a speaker, etc. The power supply 1150 may supply power for operations of the electronic device 1100. The display device 1160 may be coupled to other components through the buses or other communication links.

In the display device 1160, first and second source voltages of a driving transistor of each pixel in a selected pixel row may be measured at first and second time points of a sensing time within a vertical blank period, a current saturated source voltage of the driving transistor may be predicted based on the first and second source voltages, a threshold voltage change amount of the driving transistor may be calculated based on a difference between a previous saturated source voltage and the current saturated source voltage, and a threshold voltage of the driving transistor may be determined based on the threshold voltage change amount. Accordingly, since the current saturated source voltage of the driving transistor after saturation is predicted using the first and second source voltages of the driving transistor before saturation, a sensing operation that senses the threshold voltage of the driving transistor may be accurately and efficiently performed in real time while the display device 1160 displays an image.

The inventive concepts may be applied to any electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

Although certain embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A display device comprising:

a display panel comprising a plurality of pixel rows;

a scan driver configured to provide a scan signal and a sensing signal to each of the plurality of pixel rows;

a data driver coupled to the plurality of pixel rows through a plurality of data lines;

a sensing circuit coupled to the plurality of pixel rows through a plurality of sensing lines; and a controller configured to:

control the scan driver, the data driver, and the sensing circuit; and select a pixel row from the plurality of pixel rows in a vertical blank period of each frame period, wherein the vertical blank period comprises a sensing time in which the sensing circuit is configured to perform a sensing operation for the selected pixel row, wherein the sensing circuit is configured to:

measure a first source voltage of a driving transistor of each pixel in the selected pixel row at a first time point of the sensing time; and measure a second source voltage of the driving transistor at a second time point of the sensing time, and wherein the controller is configured to:

predict a current saturated source voltage of the driving transistor based on the first source voltage and the second source voltage; and determine a threshold voltage change amount of the driving transistor based on a difference between a previous saturated source voltage and the current saturated source voltage.

2. The display device of claim 1, wherein:

the controller is configured to determine the current saturated source voltage using an equation, i.e., "

$$SVs = \frac{Vs(T1)^2 * (T2 - T1)}{Vs(T1) * (T2 - T1) - [Vs(T2) - Vs(T1)] * T1}$$

";

SVs represents the current saturated source voltage;

Vs(T1) represents the first source voltage;

Vs(T2) represents the second source voltage;

T1 represents the first time point; and

T2 represents the second time point.

3. The display device of claim 1, wherein the threshold voltage change amount of the driving transistor is determined by subtracting the current saturated source voltage obtained by a current sensing operation from the previous saturated source voltage obtained by a previous sensing operation.

4. The display device of claim 1, wherein the pixel comprises:

the driving transistor comprising a gate, a drain configured to receive a first power supply voltage, and a source;

a first switching transistor comprising a gate configured to receive the scan signal, a drain coupled to one of the plurality of data lines, and a source coupled to the gate of the driving transistor;

a second switching transistor comprising a gate configured to receive the sensing signal, a drain coupled to the source of the driving transistor, and a source coupled to one of the plurality of sensing lines;

a storage capacitor comprising a first electrode coupled to the gate of the driving transistor, and a second electrode coupled to the source of the driving transistor; and a light emitting element comprising an anode coupled to the source of the driving transistor, and a cathode configured to receive a second power supply voltage.

5. The display device of claim 1, wherein the controller is configured to sequentially select the plurality of pixel rows on which the sensing operation is to be performed in a plurality of frame periods.

6. The display device of claim 1, wherein the controller is configured to randomly select the pixel row on which the sensing operation is to be performed from the plurality of pixel rows in each frame period.

7. The display device of claim 1, wherein a gate voltage of the driving transistor is fixed to a sensing data voltage during the sensing time.

8. The display device of claim 1, wherein:

the data driver is configured to apply a sensing data voltage to the plurality of data lines during the sensing time;

the scan driver is configured to apply the scan signal and the sensing signal to the selected pixel row during the sensing time; and the sensing circuit is configured to:

apply a reference voltage to the plurality of sensing lines before the sensing time;

measure the first source voltage by sampling a voltage of each of the plurality of sensing lines at the first time point of the sensing time; and measure the second source voltage by sampling the voltage of each of the plurality of sensing lines at the second time point of the sensing time.

9. The display device of claim 1, wherein the vertical blank period further comprises, after the sensing time, a previous data writing time in which a previous data voltage applied to the pixel in an active period before the vertical blank period is applied again to the pixel.

10. The display device of claim 1, wherein:

a reference threshold voltage of the pixel is sensed when a previous driving period of the display device ends; and a threshold voltage of the driving transistor is determined by cumulatively adding the threshold voltage change amount to the reference threshold voltage during a current driving period of the display device.

11. The display device of claim 10, further comprising:

a compensation data memory configured to store compensation data corresponding to the threshold voltage of the driving transistor, wherein the controller is configured to correct input image data based on the compensation data.

12. A method of sensing a threshold voltage in a display device comprising a plurality of pixel rows, the method comprising:

selecting a pixel row from the plurality of pixel rows in a vertical blank period of each frame period;

measuring a first source voltage of a driving transistor of each pixel in the selected pixel row at a first time point of a sensing time within the vertical blank period;

measuring a second source voltage of the driving transistor at a second time point of the sensing time;

predicting a current saturated source voltage of the driving transistor based on the first source voltage and the second source voltage; and determining a threshold voltage change amount of the driving transistor based on a difference between a previous saturated source voltage and the current saturated source voltage.

13. The method of claim 12, wherein:

predicting the current saturated source voltage of the driving transistor comprises:

determining the current saturated source voltage by using an equation, i.e., "

$$SVs = \frac{Vs(T1)^2 * (T2 - T1)}{Vs(T1) * (T2 - T1) - [Vs(T2) - Vs(T1)] * T1}$$

",

SVs represents the current saturated source voltage;

Vs(T1) represents the first source voltage;

Vs(T2) represents the second source voltage;

T1 represents the first time point; and

T2 represents the second time point.

14. The method of claim 12, wherein determining the threshold voltage change amount of the driving transistor comprises:

determining the threshold voltage change amount of the driving transistor by subtracting the current saturated source voltage obtained by a current sensing operation from the previous saturated source voltage obtained by a previous sensing operation.

15. The method of claim 12, wherein selecting the pixel row comprises: sequentially selecting the plurality of pixel rows on which a sensing operation is to be performed in a plurality of frame periods.

16. The method of claim 12, wherein selecting the pixel row comprises: randomly selecting the pixel row on which a sensing operation is to be performed from the plurality of pixel rows in each frame period.

17. The method of claim 12, further comprising:

applying a reference voltage to a sensing line coupled to the pixel before the sensing time;

applying a sensing data voltage to data line coupled to the pixel during the sensing time; and applying a scan signal and a sensing signal to the pixel during the sensing time.

18. The method of claim 17, wherein:

measuring the first source voltage comprises sampling a voltage of the sensing line at the first time point of the sensing time; and measuring the second source voltage comprises sampling the voltage of the sensing line at the second time point of the sensing time.

19. The method of claim 12, further comprising:

after the sensing time, again applying, to the pixel, a previous data voltage applied to the pixel in an active period before the vertical blank period.

20. The method of claim 12, further comprising:

sensing a reference threshold voltage of the pixel when a previous driving period of the display device ends;

determining a threshold voltage of the driving transistor by cumulatively adding the threshold voltage change amount to the reference threshold voltage during a current driving period of the display device;

storing compensation data corresponding to the threshold voltage of the driving transistor; and correcting input image data based on the compensation data.

* * * * *